US009338832B2

(12) United States Patent
Wright et al.

(10) Patent No.: US 9,338,832 B2
(45) Date of Patent: May 10, 2016

(54) INDUCTION ACTIVATED THERMAL BONDING

(71) Applicant: Apple Inc., Cupertino, CA (US)

(72) Inventors: Derek W. Wright, San Francisco, CA (US); Erik A. Uttermann, Cupertino, CA (US); Stephen R. McClure, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 144 days.

(21) Appl. No.: 13/889,225

(22) Filed: May 7, 2013

(65) Prior Publication Data

US 2014/0117006 A1 May 1, 2014

(51) Int. Cl.
*H05B 6/10* (2006.01)
*H05B 6/14* (2006.01)

(52) U.S. Cl.
CPC . *H05B 6/105* (2013.01); *H05B 6/14* (2013.01)

(58) Field of Classification Search
CPC ..... H05B 6/14; H05B 6/105
USPC ..... 156/272.2, 272.4
See application file for complete search history.

(56) References Cited

U.S. PATENT DOCUMENTS

| | | | | | |
|---|---|---|---|---|---|
| 4,741,796 | A * | 5/1988 | Althaus et al. | ..... | 156/272.4 |
| 5,266,764 | A * | 11/1993 | Fox et al. | ..... | 219/672 |
| 5,500,511 | A * | 3/1996 | Hansen et al. | ..... | 219/633 |
| 5,644,837 | A | 7/1997 | Fathi et al. | | |
| 5,925,201 | A * | 7/1999 | Marsden | ..... | H02G 5/066 156/294 |
| 6,256,482 | B1 * | 7/2001 | Raab | ..... | 455/108 |
| 6,312,548 | B1 | 11/2001 | Fathi et al. | | |
| 6,734,409 | B1 * | 5/2004 | Wang et al. | ..... | 219/759 |
| 7,931,063 | B2 | 4/2011 | Craig et al. | | |
| 8,207,478 | B2 | 6/2012 | Tian et al. | | |
| 2012/0279647 | A1 * | 11/2012 | Staiger et al. | ..... | 156/272.2 |
| 2013/0020022 | A1 * | 1/2013 | Keite-Telgenbuscher | | B29C 65/368 156/272.2 |

FOREIGN PATENT DOCUMENTS

| | | | | |
|---|---|---|---|---|
| DE | 102009055091 | * | 6/2011 | ..... B29C 65/368 |
| WO | WO 2011051097 A2 | * | 5/2011 | |

* cited by examiner

*Primary Examiner* — Daniel McNally
(74) *Attorney, Agent, or Firm* — Downey Brand LLP

(57) ABSTRACT

The described embodiment relates generally to the field of inductive heating. More specifically an inductive heater designed for use in assembling electronics is disclosed. A number of methods for shaping a radio-frequency (RF) receiver structure are disclosed for the purpose of completing an inductive bonding process without causing harm to adjacent electrical components.

17 Claims, 11 Drawing Sheets

INDUCTION ACTIVATED THERMAL BONDING

CROSS REFERENCE TO RELATED APPLICATIONS

The present application claims the benefit under 35 U.S.C. 119(e) of U.S. Prov. Pat. Appl. No. 61/721,443, entitled "INDUCTION ACTIVATED THERMAL BONDING," by Derek W. Wright, et al. filed on Nov. 1, 2012, and U.S. Prov. Pat. Appl. No. 61/801,777, entitled "INDUCTION ACTIVATED THERMAL BONDING," by Derek W. Wright, et al. filed on Mar. 15, 2013, the contents of which are hereby incorporated herein by reference, in their entirety, for all purposes.

BACKGROUND

1. Technical Field

The described embodiment relates generally to the use of focused energy in electronics manufacturing. More particularly, devices and methods for using a radio-frequency (RF) alternating magnetic field to thermally bond adjoining components in an electronic assembly are described.

2. Related Art

A pressure sensitive adhesive (PSA) is an adhesive that bonds when pressure is applied to marry the adhesive with the adherent. An advantage to using PSA is that no solvent, water, or heat is required for activation since, as indicated by the name, a sufficient force is required to apply the adhesive to the surface. In some cases, though, an increased force may not increase adhesion. However, surface factors, such as smoothness, surface energy, and presence of contaminants may have a substantial influence on the ultimate bond strength and reliability. Moreover, PSA generally forms a reliable bond at room temperatures. As the temperature changes, however, the properties of the bond can change. For example, at reduced temperatures, pressure sensitive adhesives can experience reduced (or even loss) tack, whereas at high temperatures pressure sensitive adhesives can experience a reduced shear strength.

Therefore, in situations where bonded parts experience temperature variations that can adversely affect the PSA bond, a thermal bond film can be more desirable to use. Thermal bond films generally provide stronger and more reliable bond than PSAs. Also, thermal bond films may be desirable when narrow bond lines are used. However, in order to form a bond between the thermal bond film and the adherent, the thermal bond film must be exposed to sufficient heat for proper activation. The ability to deliver sufficient heat can be adversely affected by a number of extraneous factors, such as thermal properties of materials being bonded together, as well as materials in the thermal path between the heat source and the thermal bond film. The heat transfer rate from a heat source to a thermal bond film is inversely related to the thermal path resistance between the heat source and the thermal bond film. The thermal path resistance can be related to the thermal coefficients of the components within the thermal path, which when added together provide an overall resistance to the flow of heat from the heat source to the thermal bond film. Thus, thermal resistance can impose a much higher temperature at the thermal source than would otherwise be required. Furthermore, to achieve faster curing of a thermal bond film, a higher temperature may be required to achieve a desired thermal gradient. Having exceedingly hot elements in a bonding assembly can adversely affect components in the vicinity of the thermal path that are sensitive to high temperature conditions (such as plastics having a low melting point, or anodized aluminum susceptible to cracking).

Therefore what is desired is a method and apparatus for thermally activating an adhesive with a focused energy delivery.

SUMMARY OF THE DESCRIBED EMBODIMENTS

According to a first embodiment an apparatus for focused activation of an adhesive including an energy source is provided. The energy source may include an alternate current (AC) source configured to provide an AC at a driving frequency. In some embodiments a capacitor circuit selects the driving frequency. The apparatus may further include a conducting device coupled to the capacitor circuit and configured to use the AC to generate an alternating magnetic field. The conducting device may also direct a portion of the alternating magnetic field to a receiver structure proximal to the conducting device. Accordingly, the receiver structure is configured to absorb portions of the alternating magnetic field and to convert the absorbed alternating magnetic field to heat. In some embodiments the receiver structure is thermally coupled to an adhesive layer.

According to a second embodiment a receiver structure is provided. The receiver structure may include a magnetic absorption layer made of an electrically conductive material. Further, the magnetic absorbing layer is thermally coupled to an adhesive layer adjacent to an adherent component in a bonding assembly.

According to a third embodiment, a method for focused adhesive activation in a bonding assembly is presented. The method may include generating an alternating magnetic field using an induction heater. The method may also include directing the alternating magnetic field at a driving frequency to a receiver structure in the bonding assembly and converting the received alternating magnetic field to heat. In some embodiments the method includes thermally coupling an adhesive portion to the receiver structure and conductively transmitting the heat from the receiver structure to the adhesive portion. Finally, the method may include ceasing operation of the induction heater after sufficient heat has been transmitted to the adhesive portion.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

In the figures, elements referred to with the same or similar reference numerals include the same or similar structure, use, or process, as described in the first instance of occurrence of the reference numeral.

DETAILED DESCRIPTION OF EXAMPLE EMBODIMENTS

Figure 1:
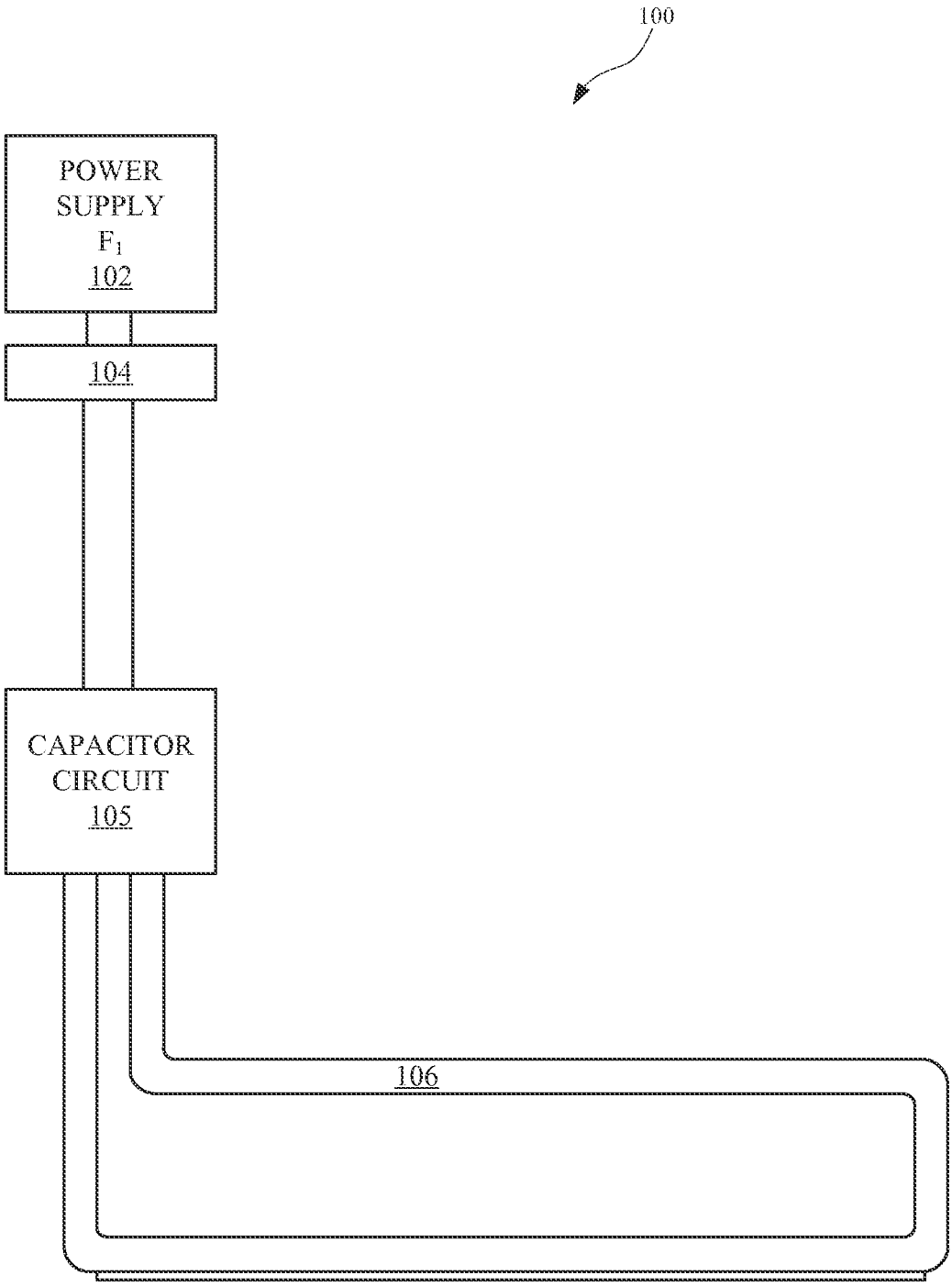
FIG. 1 is a block diagram of an induction heater system in accordance with some embodiments.

A representative apparatus and application of methods according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

In state of the art applications, pressure sensitive adhesives (PSA) are convenient when thermally activating an adhesive may result in damage to surrounding structures and materials. Some PSAs may have relatively low activation temperatures, from about room temperature (25° C.) to little above room temperature (such as about 50° C.). However, use of PSAs becomes challenging for assembling devices having reduced dimensions. The challenges arise from the difficulty to apply uniform pressure in areas having small form factors and detailed features, as is common in handheld and portable electronic devices. This may be the case for example for bonding a lens to a lens mount, especially when the mount is embedded in a complex structure, or the lens includes more than one optical element. Thermal bond films may be desirable in applications where a PSA film is challenged. For example, a PSA is typically weaker than liquid adhesives or thermal bond film adhesives. Also, application of PSAs may be difficult in portions of the substrate having narrow bends. A thermal bond film as used in some embodiments may be selectively activated at a high temperature, such as 140° C., or even more, at a localized area. Embodiments as disclosed herein avoid damage that high temperature of adhesive activation may produce to surrounding elements by precisely focusing the area of heat delivered to the adhesive. In some embodiments, elements surrounding the adhesive activation area may remain at temperatures close to, or below about 85° C., while the adhesive is activated at temperatures higher than about 140° C. in the vicinity. Thus, systems and methods for focused activation of an adhesive as disclosed herein maintain structural and functional integrity of the bonding assembly during the bonding process.

Furthermore, systems and methods as disclosed herein may provide a symmetric thermal gradient across different components in a bonding assembly. A symmetric thermal gradient may be desirable in configurations where different components have different thermal properties. Furthermore, systems and methods as disclosed herein may provide an asymmetric thermal gradient in order to protect devices and components proximal to the bonding assembly.

Heater systems and methods consistent with the present disclosure may provide heat from within a bonding assembly. Thus, systems and methods consistent with the present disclosure avoid having to overheat an exterior element to provide heat to an adhesive layer embedded in the bonding assembly. This substantially reduces the risk of damaging delicate components in the proximity of the bonding area.

Embodiments according to the present disclosure result in a focused heat transfer to a selected adhesive activation area. To achieve focused heat transfer, some embodiments transmit an alternating magnetic field to a receiver structure in a bonding assembly. A receiver structure according to some embodiments may include a metallic material that produces a magnetic hysteresis placed within a bonding structure. In that regard, a conductive material which is also ferromagnetic (or 'ferrous') may provide enhanced magnetic hysteresis properties. Eddy currents generated in metallic materials by the incident magnetic field combined with magnetic hysteresis losses of ferrous materials enable a focused heating of an adhesive layer. For example, some embodiments include a steel film or another ferrous material between bond film layers to receive the alternating magnetic field in a selected area. Thus generating a focused heat flow into an adhesive film layer. Embodiments as disclosed herein may be used with substrates having low thermal conductivity, or substrates susceptible to damage under high temperatures (low melting T). For example, under high temperature some materials may present discoloration, surface blemishes, warping, or undesirable out-gassing, among other problems. In such circumstances, a focused heat source placed in a selected area provides a high adhesive activation temperature without risking damage to surrounding elements. For example, the receiver structure acting as a heat source may be located in close proximity to the adhesive, or embedded within. Thus, elements distant from the heat source receive a limited amount of heat.

Embodiments consistent with the present disclosure can focus a heat flow in parts of devices that are difficult to access with conventional tools. For example, in a bonding assembly adherent components may be obstructed by a surrounding element, or occluded by a portion of a substrate, a chassis, or a frame. In such configurations, it may be difficult to reach and provide heat to an adhesive portion adjacent to the adherent components. Moreover, it may be difficult to hold an adherent component in order to maintain structural support for the bonding assembly, while the adhesive is curing. Embodiments consistent with the present disclosure allow the heating of adhesive portions in bonding assemblies that are hard to reach otherwise. Also, embodiments as disclosed herein can apply a force to an adherent component to maintain structural support for the bonding assembly, while the adhesive is cured.

Induction heating is the process of heating an electrically conducting object (usually a metal) by electromagnetic induction. An induction heater can include an electromagnet, through which a high-frequency alternate current (AC) is passed. Electromagnetic induction may be generated by an alternating magnetic field incident on the object. Electromagnetic induction generates eddy currents within a metal, and the natural resistance to current flow leads to Joule heating of the metal. Heat may also be generated by magnetic hysteresis losses in materials that have significant magnetic permeability. The frequency of AC used depends on the object size, material type, coupling (between the conducting device and the object to be heated) and the penetration depth.

Accordingly, an apparatus and method for thermally activating a thermal bond layer in situ using alternating magnetic field induced heating is described. The apparatus includes a focused energy source configured to generate an alternating magnetic field at a selected frequency or range of frequencies, such as a frequency bandwidth. In some embodiments the focused energy source includes at least an AC current source configured to drive an conducting device with an AC at a driving frequency. The energy converter can take the form of an induction heater system configured to convert the AC at the driving frequency to an alternating magnetic field that oscillates at the driving frequency. The driving frequency may be a radio-frequency (RF) within a selected RF band. In some embodiments, an RF band may be between about a hundred Megahertz (MHz, 1 MHz=$10^6$ Hz) up to a few Gigaherz (GHz, 1 GHz=$10^9$ Hz). Some embodiments may use electromagnetic radiation with frequencies lower than 100 MHz, such as a few tens of MHz, or even lower. On the other hand, some embodiments may use electromagnetic radiation with frequencies higher than a few GHz, such as 100 GHz, or even higher. The alternating magnetic field is emitted by a transmitter that directs at least a portion of the alternating magnetic field to a receiver structure.

The receiver structure can be part of an assembly stack that includes a thermal bond layer in thermal contact with the receiver structure and at least one adherent structure. In one embodiment, the receiver structure can be part of an assembly stack in the bonding assembly. The receiver structure converts the alternating magnetic field to heat used to activate the thermal bond layer. In some embodiments, the activated thermal bond layer can secure the receiver structure to the assembly stack. In this way, components can be used as both a structural component and as an inductive heating component. Accordingly, the receiver structure can be tuned in such a way that a substantial portion of the received alternating magnetic field is converted to heat that is deposited directly in the receiver structure. The deposited heat is then transported from the receiver structure by way of thermal conduction to a thermal bond layer. The heat thermally activates the thermal bond layer. In one embodiment, the alternating magnetic field source can be embodied within a press head used to apply a predetermined force to the thermal bond layer and adherents, in combination with an alternating magnetic field. In one embodiment, the induction heater system can include a press to apply pressure to the assembly stack as well as direct an alternating magnetic field to the receiver structure in the assembly stack. Embodiments including a press are able to exert a specific amount of pressure for a period of time, at a selected temperature. Thus, a uniform coupling can be made between the thermal bond layers and the adherent components in a bond assembly.

It should be noted that the receiver structure can take many forms, according to embodiments disclosed herein. For example, the receiver structure can take the form of a metal foil, a metallized plastic film, a conductive mesh, or in some cases, conductive particles within a non-conductive substrate. In this way, the ability to tune the alternating magnetic field to specific receiver shapes and composition can be advantageously used to deliver specific amounts of heat at specific locations. This may also enable optimization of adhesive placement for maximum adhesive strength. Embodiments consistent with the present disclosure provide a controlled and focused heat deposition. Using a focused adhesive activation, some embodiments consistent with the present disclosure are desirably used for lens mounting applications. In a lens mounting procedure, the area where the adhesive is desirably activated is typically reduced in comparison with surrounding components, such as the lens and the mounting. The lens material is typically glass, and the mounting can be aluminum or some other metal or rigid material. To avoid damage or stress to the glass, or glass coating, and misalignment of the lens relative to the mount while the adhesive cures, it is desirable to have a focused heat application, such as provided in embodiments disclosed herein.

In another embodiment, methods and systems consistent with the present disclosure may be applied for bonding a cover glass to a product housing. The product housing may be used in a portable electronic device such as a handheld electronic device such as a cellular phone, a tablet computer, a laptop computer, or the like.

FIG. 1 is a block diagram of an embodiment of an induction heater system 100 in accordance with the described embodiments. As shown, induction heater system 100 can include power supply 102 that can operate at an alternating frequency. Accordingly, induction heater system 100 may include a transducer converting 'direct current' (DC) into an alternating magnetic field. The current is converted into a magnetic field by a conducting device 106. In some embodiments, conductive device 106 may be an induction coil made of an electrically conductive material such as copper. The shape of conductive device 106 may define an area where the magnetic field is applied, and thus the heat generation is localized to that area. The magnetic field may be alternating at a selected working frequency. Accordingly, the magnetic field may change direction by approximately 180° at the selected working frequency. In some embodiments, the alternating magnetic field may be super-imposed to a constant magnetic field offset pointing in a specific direction. For example, the constant magnetic field offset may be desirable to adjust a ferromagnetic member of the bonding assembly during the bonding process.

In some instances, a particular power supply frequency can have particular induction heating characteristics geared for a specific shape of conductive device 106 and a given bonding component shape. Thus, selecting a particular alternating frequency can be advantageous for a given component, component size, etc. In some embodiments, the output of power supply 102 can be controlled by power supply controller 104. Power supply controller 104 couples power supply 102 to conducting device 106 through a capacitor circuit 105. In some embodiments, power supply 102 can include an adjustable alternating frequency. In such embodiments, a single power supply can be used to provide power at varying frequencies to conductive device 106. Thus, the amount of alternating magnetic field as well as the penetration depth of the alternating magnetic field can be desirably controlled.

In some embodiments, induction heater system 100 may include capacitor circuit 105 to select the driving frequency for operating conducting device 106. Capacitor circuit 105 may include any number of electronic components, including capacitors, transistors, inductors, or any other components used for frequency operation of an electronic device. Embodiments as disclosed herein may be useful when disparate adherent components are included in a bonding assembly. In such configurations, it may be desirable to use different adhesive layers adjacent to each of the different adherent components.

Figure 2:
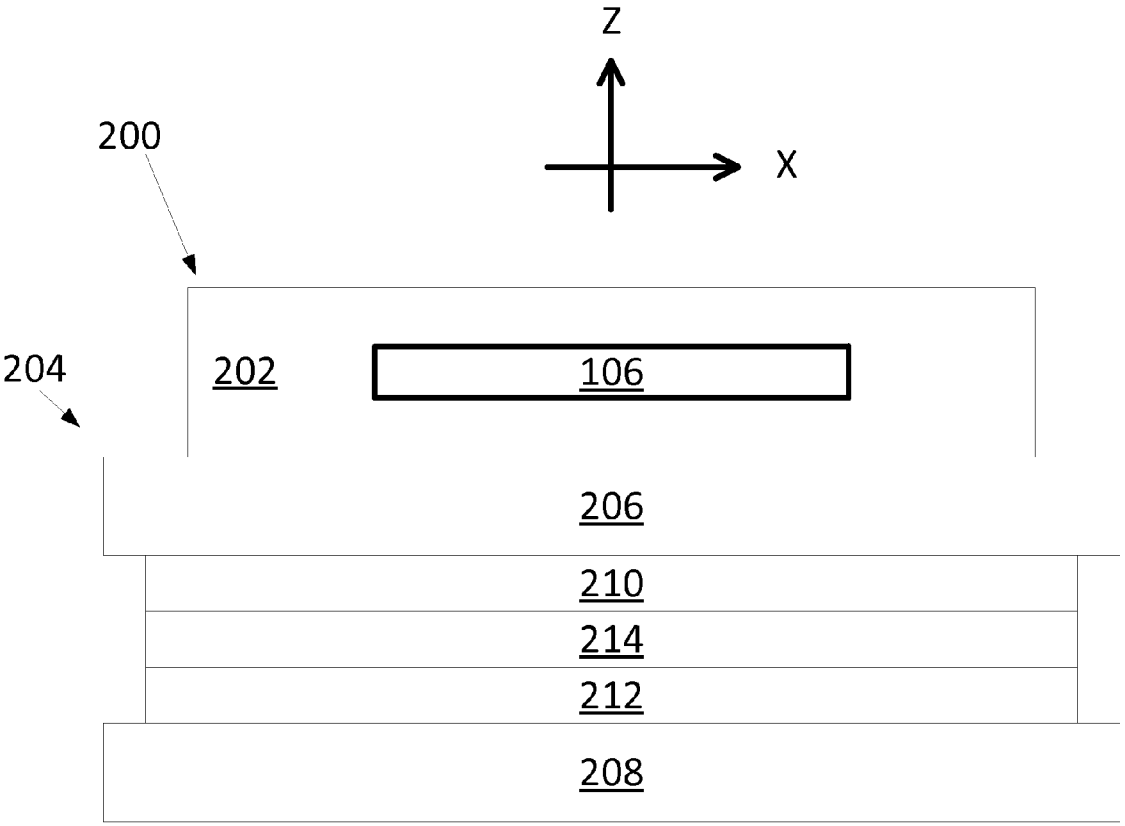
FIG. 2 shows a perspective view of an inductive thermal bonder incorporating an induction heating system according to some embodiments.

FIG. 2 shows a perspective view an embodiment of an inductive thermal bonder 200 incorporating induction heating system 100, according to some embodiments. In particular, induction thermal bonder 200 can include conducting device 106 incorporated into head structure 202. It should be noted that while conducting device 106 is shown shaped as a tight parallel coil, any number of other shapes are also possible as alternate configurations. For example, in some embodiments the distribution and strength of the magnetic field may be adapted to properly match the induction heating target. As shown in FIG. 2, conducting device 106 can be shaped in such a way that an alternating magnetic field induces eddy currents (and thus induction heating) in a focused area where heat deposition is desired. Induction thermal bonder 200 can be used to direct the alternating magnetic field at assembly stack 204. Assembly stack 204 can include adherent components 206 and 208. Adherent components 206 and 208 are bonded together using adhesive layers 210 (and 212) thermally coupled to receiver structure 214. Adhesive layers 210 and 212 may include a thermal bond film, according to some embodiments.

The particular choice of Cartesian coordinates XZ in FIG. 2 is arbitrary and shown for illustrative purposes only.

In the described embodiments, receiver structure 214 is configured to receive the alternating magnetic field from conducting device 106. In this way, the alternating magnetic field energy provided by conducting device 106 can induce eddy currents within magnetic receiver structure 214. The eddy currents heat receiver structure 214 and the heat is transported by way of conduction to adhesive layers 210 and 212. In other words, eddy currents can be induced at a distance from conducting device 106 without physical contact between conducting device 106 and components 206 and 208. The magnetic field emanating from conducting device 106 can also be designed so that heating of surrounding components is limited to selected areas of assembly stack 204. In this way, areas of assembly stack 204 can remain relatively cool and not be subjected to heating. In some embodiments, receiver structure 214 can have asymmetric thermal properties (as well as asymmetric absorption properties). In this way, heat can be generated or asymmetrically transmitted in accordance with specific configurations of assembly stack 204. For example, magnetic receiver structure 214 can take the form of a mesh, a shaped metal foil, or a layered structure having a magnetic field absorbing material on one side and a low heat conducting material (such as a ceramic or a different adhesive layer) on the other. The mesh may have metallic wires woven to form a first pitch. In this way, heat generated by the alternating magnetic field received is transported to one side of magnetic receiver structure 214 faster than to the opposite side of magnetic receiver structure 214. This may result in a more even thermal gradient across assembly stack 204 when the heat is transported faster to a portion of the stack having lower thermal conductivity. In some embodiments, head structure 202 can exert a force onto assembly stack 204. The applied force can help flatten, align, and properly position adherent components 206 and 208 with respect to adhesive layers 210 and 212.

It should be noted that receiver structure 214 can take many forms. For example, receiver structure 214 can take the form of a metal foil, a metallized plastic film, a conductive mesh, or in some cases, conductive particles within a non-conductive substrate. In this way, the ability to tune the alternating magnetic field to specific receiver shapes can deliver specific amounts of alternating magnetic fields at specific locations. This in turn provides a controlled and localized heat deposition.

In some embodiments, it is desirable that adhesive layers 310 and 312 be made of a liquid material. Liquid adhesives are convenient because they are gap filling and are generally stronger after curing. While curing times for liquid adhesives is typically long, curing time may be substantially reduced by applying localized heat, as in embodiments disclosed herein.

Figure 3:
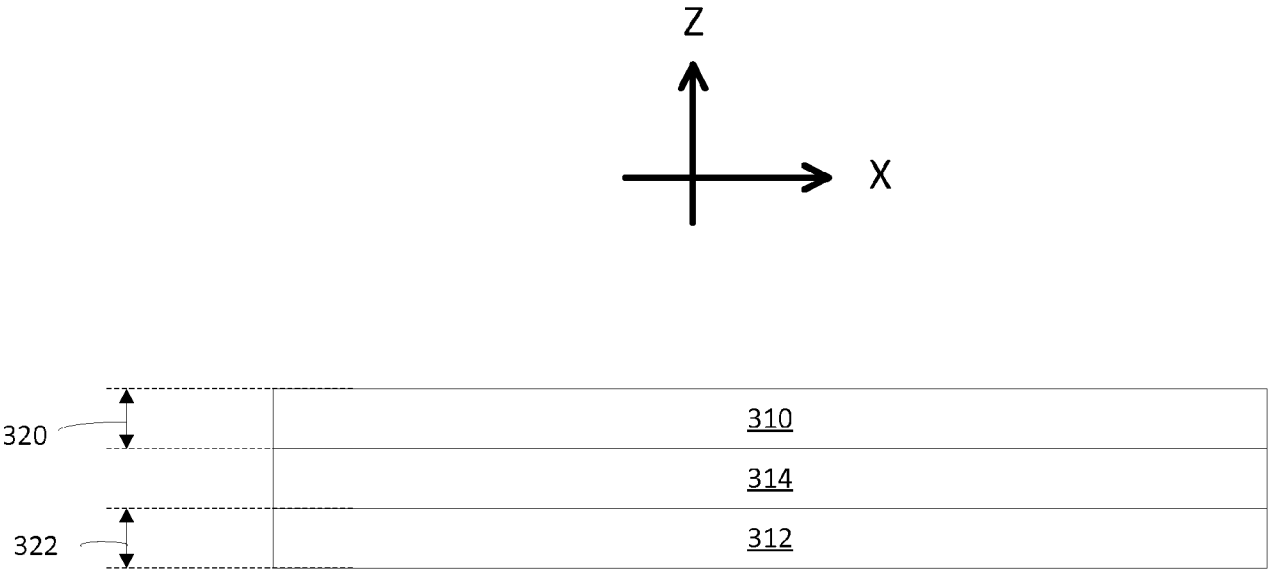
FIG. 3 shows a cross sectional view of a magnetic receiver structure according to some embodiments.

FIG. 3 shows a cross sectional view of a magnetic receiver structure 314 according to some embodiments. As shown in FIG. 3, adhesive layers 310 and 312 may be adjacent to magnetic receiver structure 314. Adhesive layer 310 may have a first thickness 320, and adhesive layer 312 may have a second thickness 322. Accordingly, first thickness 320 may be different from second thickness 322. Varying the thickness of adhesive layers 310 and 312 may result in a heat transfer that is symmetric along the Z-axis. This may provide the same heating temperature to adhesive layers 310 and 312 that may have different chemical composition and thus different thermal properties. In some embodiments, it may be desirable to create an asymmetric thermal gradient along the Z-axis. For example, the bonding assembly may be proximal to delicate circuitry in the bottom, or at the top, of magnetic receiver structure 314. In such embodiments, having first thickness 310 different from second thickness 322 may be desirable to create an asymmetric thermal gradient.

The particular choice of Cartesian coordinates XZ in FIG. 3 is consistent with that of FIG. 2.

Figure 4:
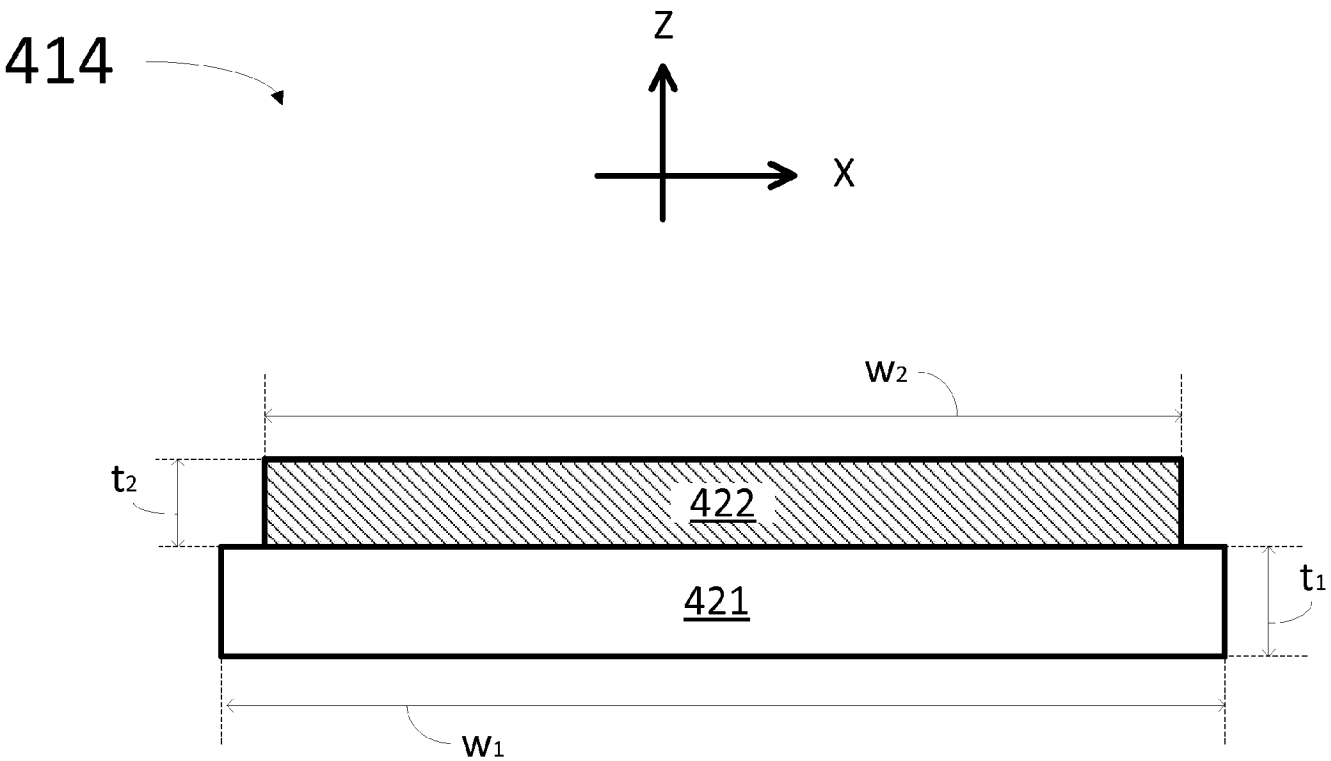
FIG. 4 shows a plan view of a magnetic receiver structure according to some embodiments.

FIG. 4 shows a cross sectional view of a magnetic receiver structure 414 according to some embodiments. Magnetic receiver structure 414 includes a low heat conductivity layer 421, and a magnetic receiving layer 422. As shown in FIG. 4, low heat conductivity layer 421 may have different thickness '$t_1$', and width '$w_1$', as compared to magnetic absorption layer 422 ($t_2$, and $w_2$, respectively). Low thermal conductivity layer 421 may include a dielectric material such as glass, plastic or ceramic, or a polymer material having a high dielectric constant, such as polyimide. In some embodiments, low thermal conductivity layer 421 may include an optical component, such as a lens, a mirror, a prism, or a portion of an optical fiber. Magnetic absorption layer 422 may include a metal or an electrically conductive material such as copper, aluminum, tin, or gold.

Accordingly, magnetic absorption layer 422 absorbs an alternating magnetic field and generates heat. The generated heat is transmitted to portions of the bonding assembly on one side of structure 414 through low thermal conductivity layer 421. In some embodiments low thermal conductivity layer 421 includes materials so that elements in the assembly stack adjacent to layer 421 receive a lesser amount of heat from magnetic absorption layer 422. This may reduce the risk of damaging delicate elements in the bonding assembly proximal to the bonding surface. In some embodiments, elements on the side of magnetic receiving structure 414 adjacent to layer 421 may have a high thermal conductivity that compensates the low thermal conductivity of layer 421. In such embodiments, having low thermal conductivity layer 421 may enable having a symmetric thermal gradient across the Z-axis in the bonding assembly.

The particular choice of Cartesian coordinates XZ in FIG. 4 corresponds to that of FIG. 2.

Figure 5:
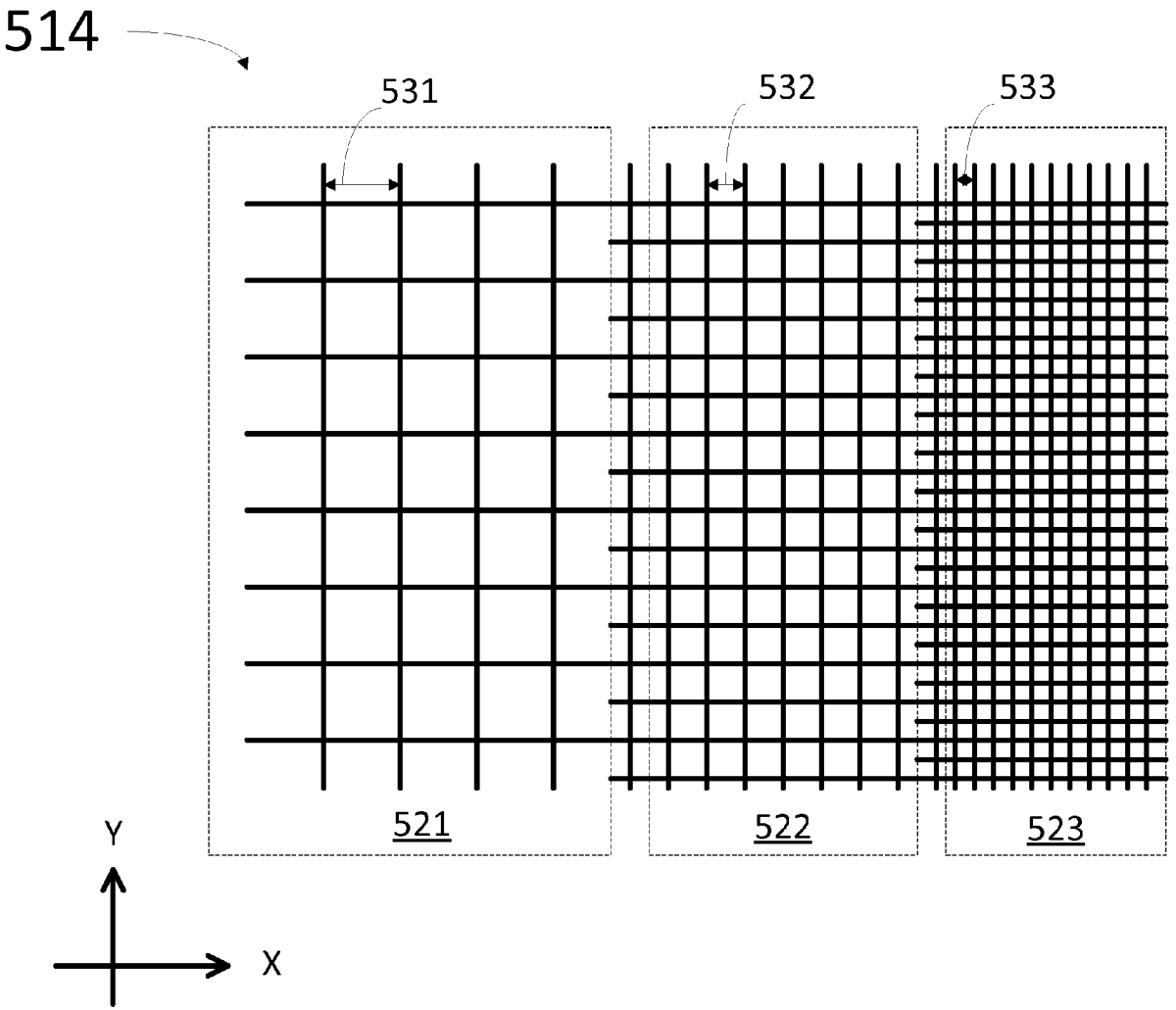
FIG. 5 shows a plan view of a magnetic receiver structure according to some embodiments.

FIG. 5 shows a plan view of a magnetic receiver structure 514 according to some embodiments. Magnetic receiver structure 514 has a mesh or grid shape formed of conductive wires. In some embodiments magnetic receiving structure 514 may be formed by weaving a plurality of conductive wires. The mesh in receiver structure 514 has a graded pitch. The graded pitch defines regions 521, 522, and 523, such that each region has a consistent first pitch diameter 531, second pitch diameter 532, and third pitch diameter 533, respectively. Accordingly, heat transfer into the adhesive layers has different efficiency in regions 521, 522, and 523. For example, the temperature reached by the adhesive layer overlapping portion 523 may be lower than the temperature reached by the adhesive layer overlapping portion 521.

The shape and size of regions 521, 522, and 523 may be determined according to different heat desirability for the adhesive layer overlapping the regions. To obtain uniform bonding the adhesive may be desirably heated at the same temperature across a certain area of a substrate, according to some embodiments. However, the substrate portion overlapping an adhesive layer may have different heat conductivities in different portions. For example, in some embodiments a first substrate portion may include steel, and in some embodiments a second substrate portion may include aluminum. A graded grid having regions 521, 522, and 523 transmits heat with different efficiency in each of the regions. Thus, magnetic receiving structure 514 provides a differentiated amount of heat to the adhesive in the vicinity of each of regions 521, 522, and 523. In embodiments where the substrate has different thermal properties, the adhesive layer (e.g., layers 210 and 212, cf. FIG. 2) can reach approximately the same temperature over different substrate portions. This results in uniform bonding across an area overlapping regions 521, 522, and 523.

In some embodiments, it may be desirable that different substrate portions of be heated at different temperatures due to different bonding requirements. For example, a portion of a substrate overlapping region 521 may include an adhesive layer that is activated at a first temperature. And a portion of a substrate overlapping region 522 may include an adhesive layer that is activated at a second temperature. The first temperature may be different from the second temperature. For example, the first temperature may be lower than the second temperature. In such configuration, pitch 531 in region 521 may be selected to transmit heat at a lower rate than region 522. Thus, the amount of heat provided by region 521 is lower than the amount of heat provided by region 522, resulting in a lower first temperature, compared to the second temperature.

The number of mesh regions illustrated in FIG. 5 is illustrative only, and should not be limiting in any respect. Accordingly, one of ordinary skill in the art will recognize that different shapes and areas of different mesh regions may be combined. For example, the pitch 531, 532, and 533 in adjacent regions may not gradually change in size. Thus, in some embodiments a region such as region 521 including pitch 531 may be adjacent to region 523, including pitch 533. And region 523 including pitch 533 may be adjacent to region 522. Thus, in some embodiments regions 521 and 522 may not be adjacent to each other. Moreover, the grid in magnetic receiving structure 514 can have a square lattice shape, as shown, and any other shape, such as: triangular, hexagonal, rhomboid, or irregular shape. It should be noted that a similar result may be achieved with a magnetic receiver structure 514 including conductive particles having a varying particle density in regions 521, 522, and 523. Likewise, magnetic receiver structure 514 may include a conductive film having a varying area overlapping regions 521, 522, and 523, according to embodiments consistent with the present disclosure. Moreover, in some embodiments magnetic receiving structure 514 may include a conductive film having a varying thickness overlapping regions 521, 522, and 523.

The particular choice of Cartesian coordinates XY in FIG. 5 corresponds to a 'right-handed' XYZ coordinate system consistent to that of FIG. 2.

Figure 6A:
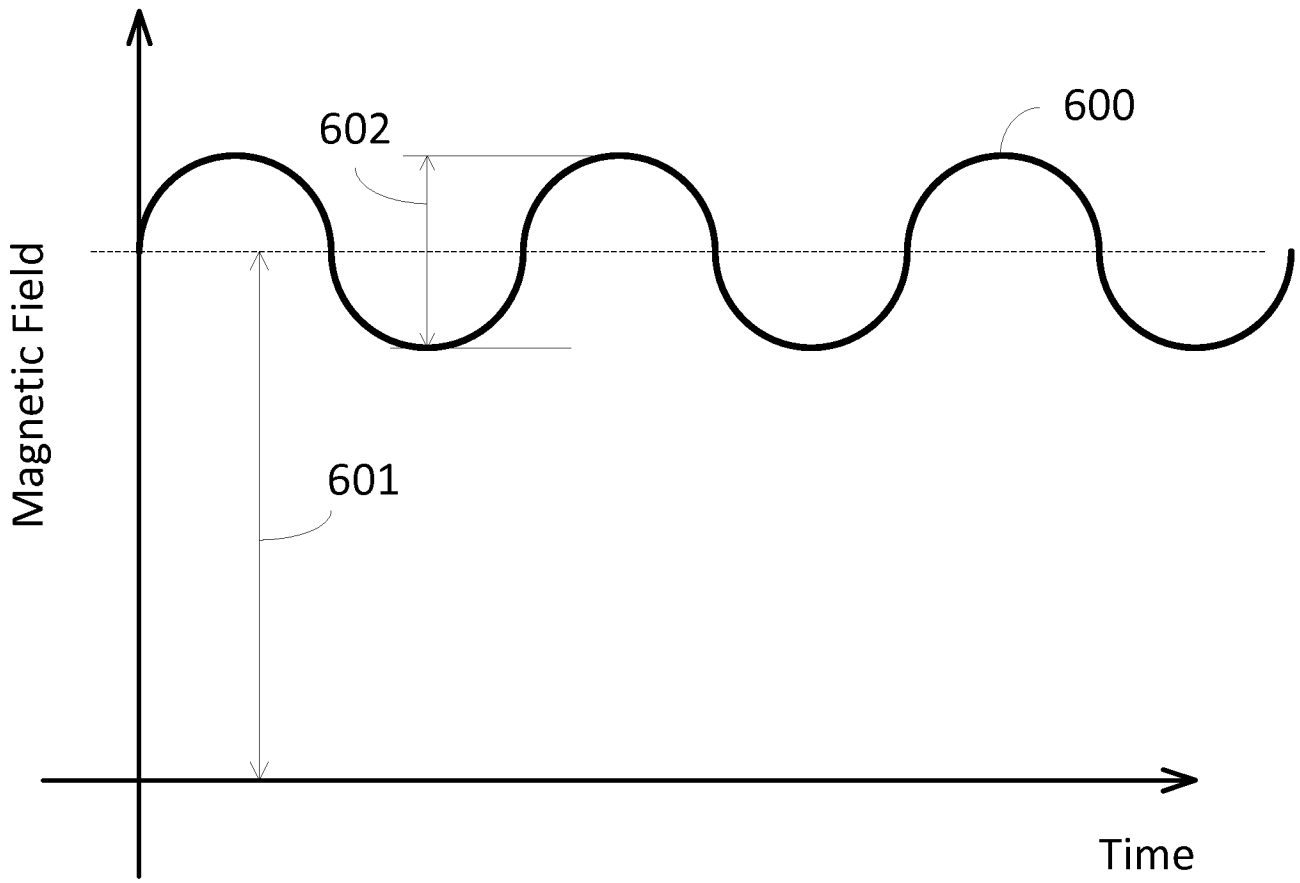
FIG. 6A shows a magnetic field used for a focused adhesive activation and bonding, according to some embodiments.

FIG. 6A shows a magnetic field 600 used for a focused adhesive activation and bonding, according to some embodiments. FIG. 6A illustrates a time plot of the magnitude of magnetic field 600. A constant offset magnetic field component 601 of magnetic field 600 is shown. And an oscillating magnetic field component 602 of magnetic field 600 is also shown. In some embodiments, component 601 may be different from zero. Component 601 may be provided by using a non-zero 'direct current' (DC) to conducting device 106 (cf. FIG. 1). Component 602 is associated to a heating process of a receiver structure according to embodiments consistent with the present disclosure. As mentioned above, the heating process may be the result of joule heating through the resistance to eddy currents induced in the receiver structure. In some embodiments, the heating process may be complemented by magnetic hysteresis, as the induced magnetization changes with the changing magnetic field. On the other hand, component 601, being non-zero, may be used for a mechanical action on adherent components during the bonding process (e.g., components 206 and 208, cf. FIG. 2). This will be described in more detail below, with reference to FIG. 6B.

Figure 6B:
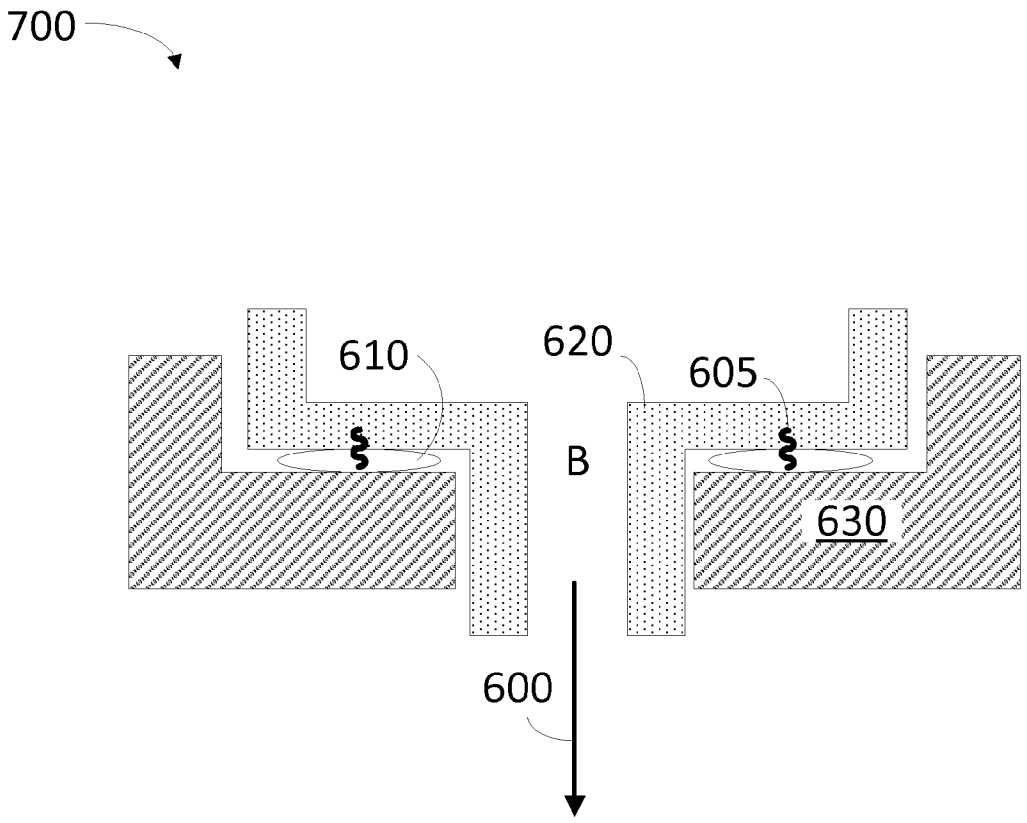
FIG. 6B shows a cross sectional view of a focused adhesive activation and bonding, according to some embodiments.

FIG. 6B shows a cross sectional view of a focused adhesive activation and bonding using magnetic field 600, according to some embodiments. FIG. 6B shows adherent components 620 and 630, and adhesive portion 610. Adherent component 620 may include steel, or some other ferromagnetic material. Thus, applying magnetic field 600 as shown in FIG. 6B has two desirable effects, as follows. While magnetic field component 601 creates a force that keeps adherent component 620 adjacent to adherent component 630 in a desired position, alternating magnetic field component 602 generates a heat flux 605 to cure adhesive portion 610. Embodiments of a focused adhesive activation and bonding process such as illustrated in FIG. 6B are desirable when access to adherent components 610 and 630 is difficult. For example, adherent component 610 may be a mount for a lens (e.g., adherent component 630), where the lens is embedded in a complex casing, or may be part of a multi-element optical component. In such configurations, components surrounding the bonding assembly may preclude using contact forces to maintain adherents 620 and 630 in place, during activation and curing of adhesive portion 610.

Figure 7:
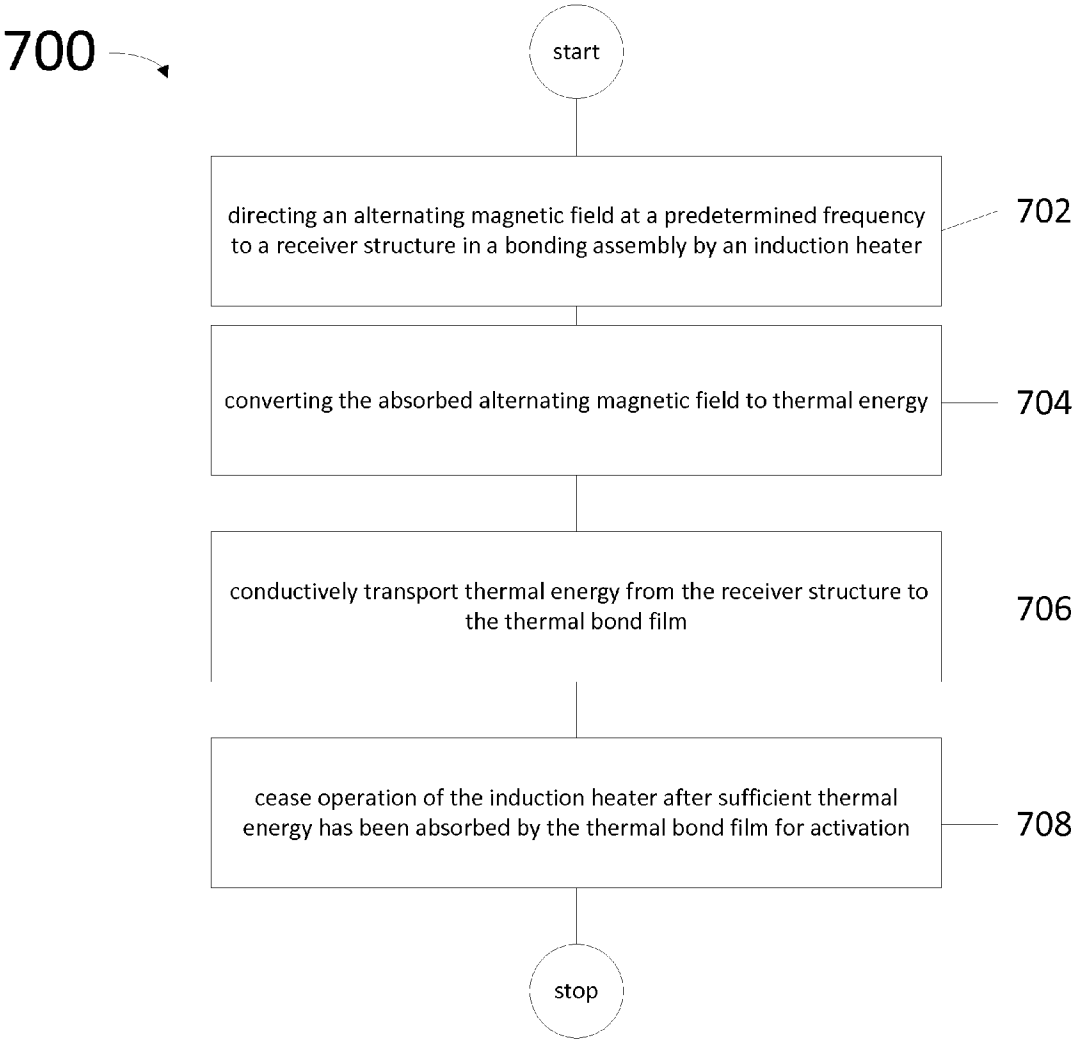
FIG. 7 shows a flowchart detailing a process in accordance with the described embodiments.

FIG. 7 is a flowchart describing process a 700 in accordance with the described embodiments. Process 700 may include a focused adhesive activation and bonding for adherent components to be used in a handheld electronic device. Process 700 may include an induction heater system configured to provide an alternating magnetic field to a receiving structure embedded within adhesive layers adjacent to the adherent components (e.g., induction heater system 100, Magnetic receiver structure 214, adherent components 206 and 208, and adhesive layers 210 and 212, cf. FIGS. 1 and 2). Step 702 includes generating an alternating magnetic field using the induction heater system. Step 702 may also include the induction heater system directing an alternating magnetic field at a predetermined frequency to the receiver structure incorporated within a bonding assembly. The bonding assembly may include at least an adhesive layer thermally coupled to an adherent component. Accordingly, the bonding assembly in step 702 may be an assembly stack (e.g., assembly stack 204, cf. FIG. 2).

Step 704 includes converting the absorbed alternating magnetic field to heat. Accordingly, in some embodiments step 704 can be performed by the receiver structure embedded within the bonding assembly. Step 706 includes conductively transmitting heat from the receiver structure to an adhesive layer. Step 708 includes ceasing the bonding operation. Step 708 may include stopping or turning the induction heater 'off'. Accordingly, step 708 may include determining that sufficient heat has been absorbed by the adhesive layer, for activation. In some embodiments, step 708 can include measuring a temperature of the adhesive layer to determine that sufficient heat has been absorbed. In some embodiments, step 708 can include allowing a pre-selected amount of time while the induction heater is 'on', to lapse.

Figure 8:
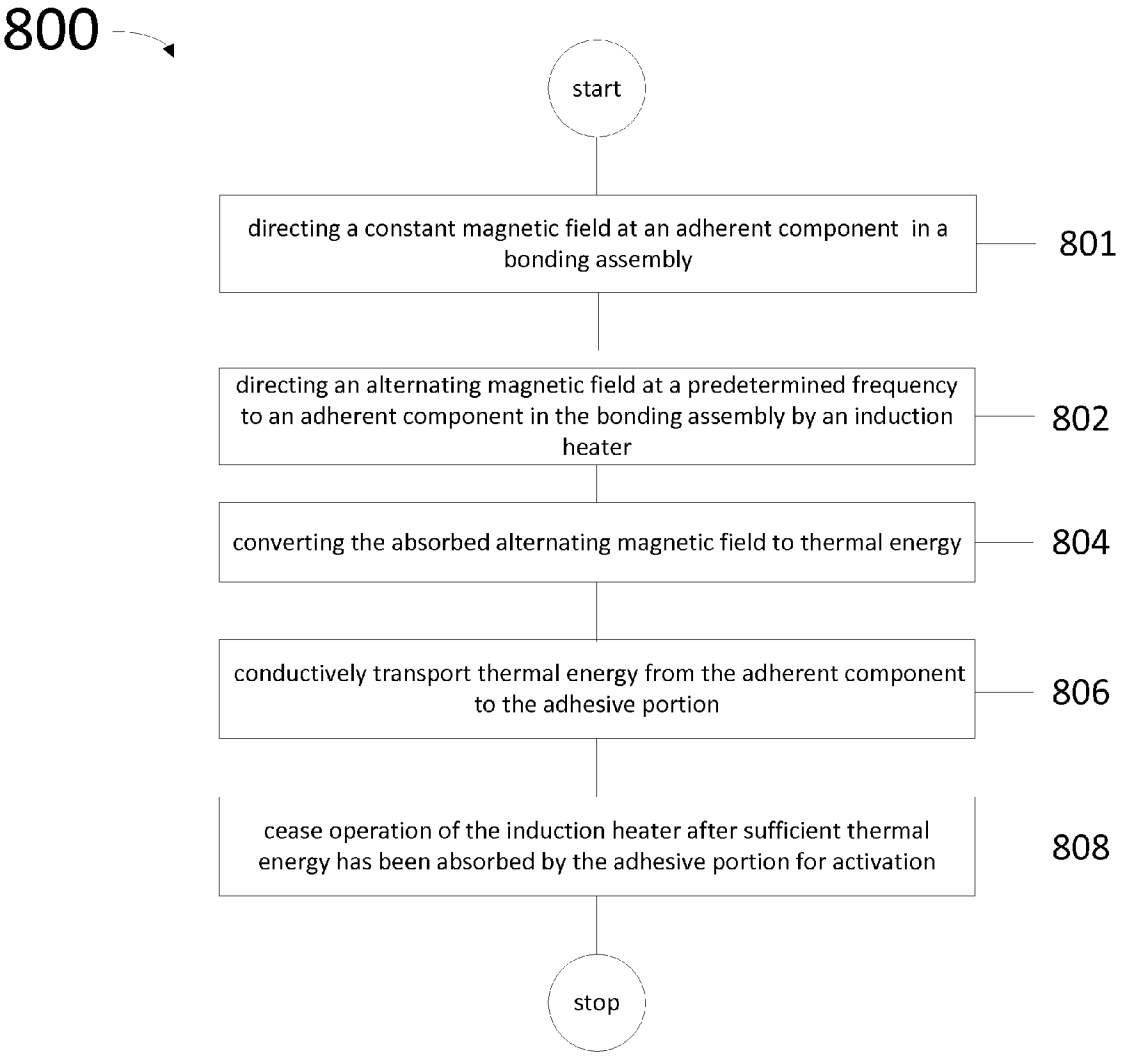
FIG. 8 shows a flowchart detailing a process in accordance with the described embodiments.

FIG. 8 is a flowchart describing a process 800 in accordance with the described embodiments. Process 800 may include a focused adhesive activation and bonding for adherent components to be used in a handheld electronic device. Process 800 may include an induction heater system configured to provide a magnetic field to a bonding assembly including adherent components (e.g., induction heater system 100, receiver structure 214, magnetic field 600, adherent components 620 and 630, and adhesive portion 610, cf. FIGS. 1, 6A and 6B). The magnetic field may include a constant offset component and an oscillating component (e.g., component 601 and oscillating component 602, cf. FIG. 6A).

Step 801 may include directing a constant magnetic field at an adherent component in the bonding assembly. Accordingly, step 801 may include applying the constant offset component of the magnetic field provided by the induction heater in the proximity of the adherent component. Thus, in embodiments consistent with the present disclosure step 801 may include applying a magnetic force to the adherent component in the bonding assembly. In some embodiments, step 801 may include applying a constant force to align the adherent component to the bonding assembly. Step 802 may be as described in detail above regarding step 702 in process 700 (cf. FIG. 7). For example, in step 802 the induction heater may direct a magnetic field alternating at a predetermined frequency to the adherent component incorporated within the bonding assembly. The adherent component in step 802 may include a ferromagnetic material, or a material having a magnetic permeability that absorbs the alternating component of the magnetic field and generates heat. The bonding assembly may include at least an adhesive portion thermally coupled with the adherent component. Accordingly, the bonding assembly in step 802 may be an assembly stack (e.g., assembly stack 204, cf. FIG. 2). Steps 804 and 806 may be as described in detail above regarding steps 704 and 706 in process 700, respectively (cf. FIG. 7). Also, step 806 may include conductively transmitting heat from the heat generating adherent component of step 802 to an adhesive portion. Step 808 may be as described in detail above regarding step 708 in process 700 (cf. FIG. 7).

In some embodiments, induction heater system 100 may be configured to provide an RF radiating energy to an RF receiving structure embedded within a bonding assembly. Accordingly, in such embodiments conducting device 106 may be configured as an RF antenna emitting RF radiation within a frequency band centered at a driving frequency. In such configurations the RF receiving structure may be an RF receiving antenna adapted to receive the RF radiation at the driving frequency. This will be described in more detail below, with reference to FIGS. 9 and 10, as follows.

Figure 9:
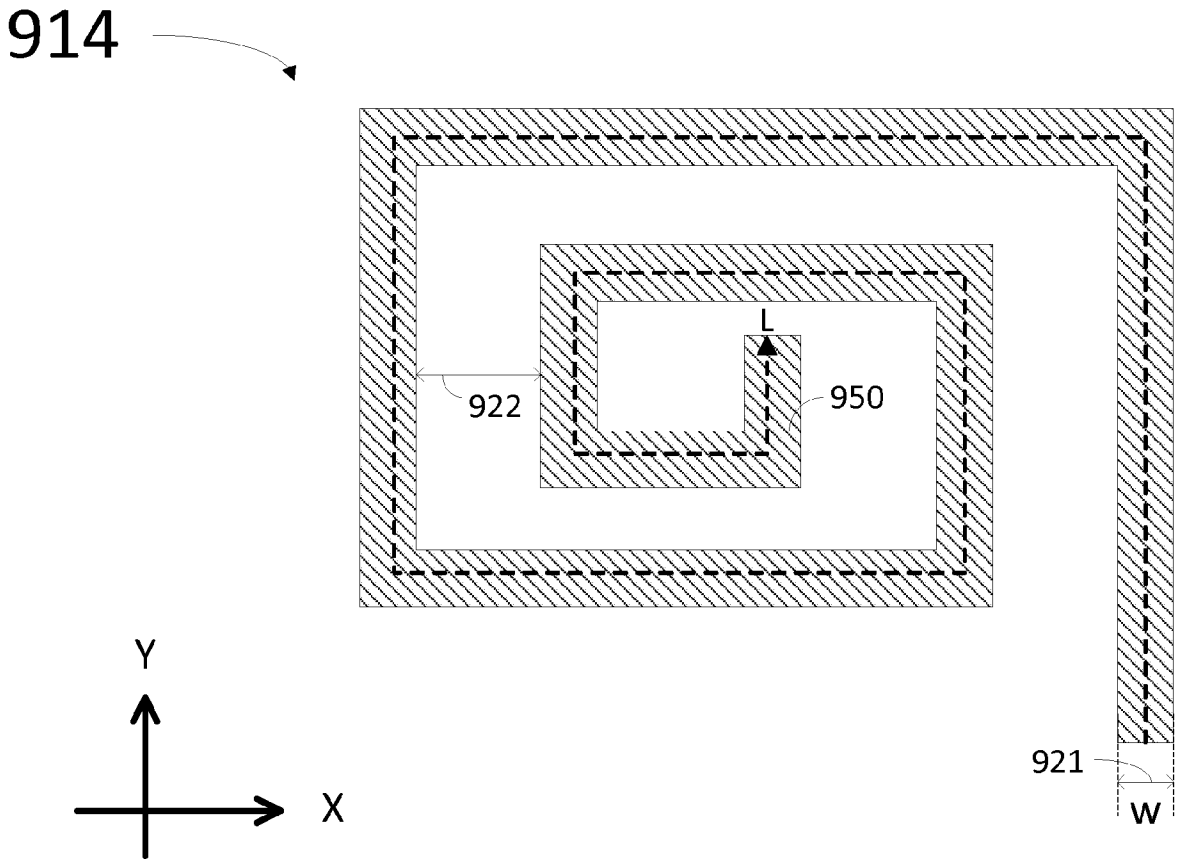
FIG. 9 shows a plan view of an RF receiver structure according to some embodiments.

FIG. 9 shows a plan view of an RF receiver structure 914 according to some embodiments. RF receiver structure 914 may be placed within a bonding assembly, consistent with embodiments disclosed herein. For example, RF receiver structure 914 may be placed as magnetic receiver structure 214 in bonding stack 204 (cf. FIG. 2). In embodiments consistent with an RF receiver structure 914, the driving frequency of an conducting device 106 may include a desired frequency band within an RF spectrum.

Receiver structure 914 has a shape and a dimension configured to effectively capture and absorb an alternating magnetic field in a pre-selected spectral region. In that regard, in some embodiments receiver structure 914 may have a varying shape in different areas overlapping the adjacent adhesive layers (e.g., layers 210 and 212, cf. FIG. 2). Likewise, in some embodiments receiver structure 914 may have portions having a varying thickness overlapping the adjacent adhesive layers. Receiver structure 914 includes an RF absorption strip 950 having a width 921 W. RF absorption strip 950 coils around to have a length, L. The width, W, and the length, L, of RF absorption strip 950 can be selected to determine the RF spectral region for absorption of an incoming alternating magnetic field. Other parameters that may determine the spectral absorption region may be the relative separation 922 between portions of RF absorption strip 950. In some embodiments, RF absorption strip 950 may be formed of an electrically conductive material such as a metal. Further according to some embodiments, RF absorption strip 950 may be adjacent to a low heat conductive layer (e.g., layer 421, cf. FIG. 4). For example, in some embodiments receiver structure 914 may be formed by depositing a metallic material over a layer of polyimide in a first step. The metallic layer thus formed may be etched away in certain portions, to achieve a coiled structure as shown in FIG. 9.

In some embodiments, the transmitter and the receiver structure may be an antenna configured to transmit and receive electromagnetic radiation in any given region of the spectrum. The electromagnetic spectral region of choice may depend on the specific application, including the RF spectral region and the microwave region, or the terahertz (THz) frequency region (1 THz=$10^{12}$ Hz).

The particular choice of Cartesian coordinates XY in FIG. 9 corresponds to a 'right-handed' XYZ coordinate system consistent to that of FIG. 2.

Figure 10:
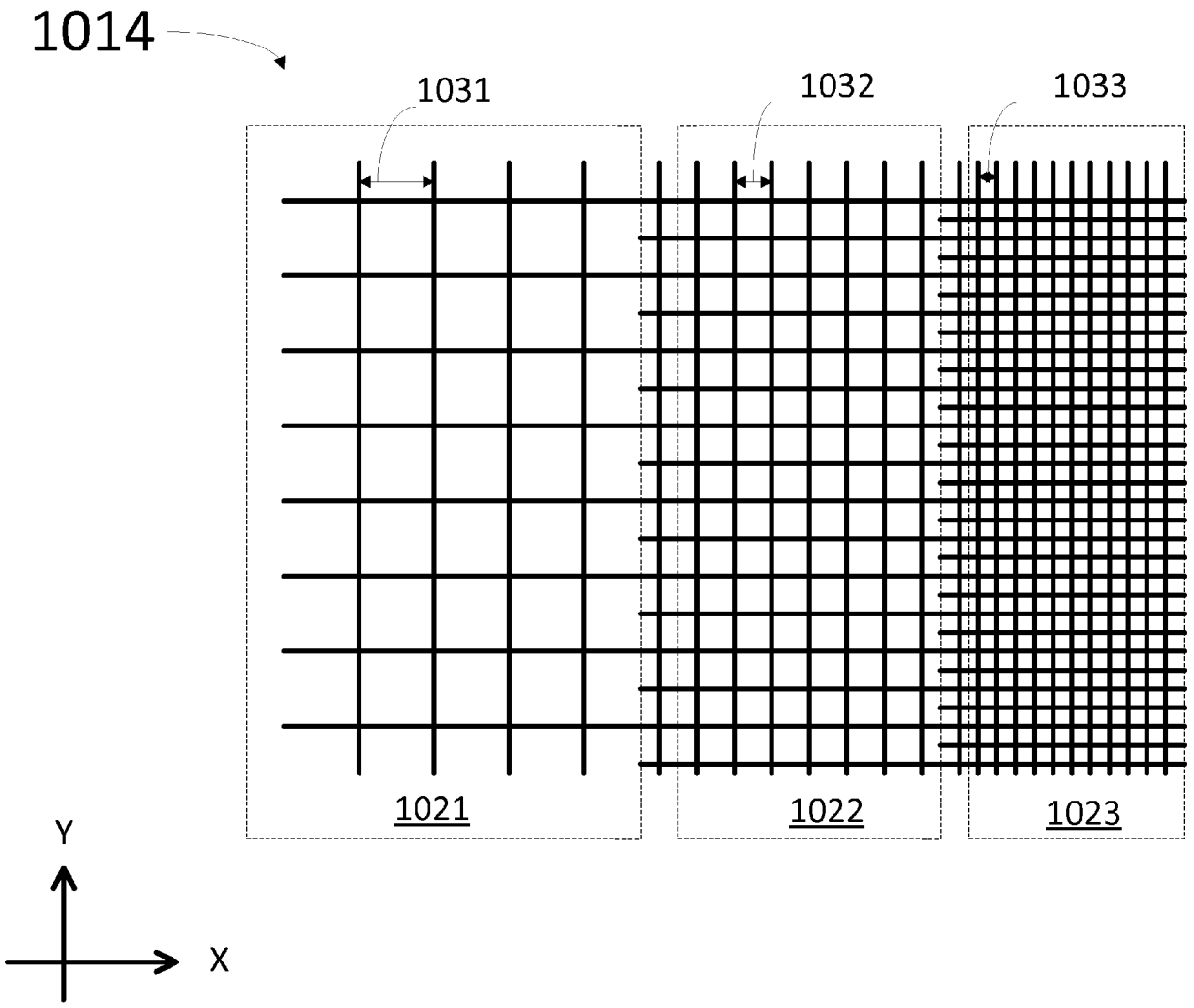
FIG. 10 shows a plan view of an RF receiver structure according to some embodiments.

FIG. 10 shows a plan view of an RF receiver structure 1014 according to some embodiments. Accordingly, a first driving frequency may be selected for activation of a first adhesive layer, or a first portion of an adhesive layer, as desired. Likewise, a second driving frequency may be selected for activation of a second adhesive layer, or a second portion of an adhesive layer. Thus, system 100 (cf. FIG. 1) can be configured to deliver RF radiation to each adhesive layer separately, by tuning the driving frequency accordingly.

RF receiver structure 1014 has a mesh or grid shape formed of conductive wires. In some embodiments RF receiver structure 1014 may be formed by weaving a plurality of conductive wires. The mesh in RF receiver structure 1014 has a graded pitch. The graded pitch defines regions 1021, 1022, and 1023, such that each region has a consistent pitch diameter 1031, 1032, and 1033, respectively. Accordingly, the mesh in RF receiver structure 1014 acts as a frequency selective antenna, wherein RF radiation is absorbed with different efficiency in regions 1021, 1022, and 1023. For example, an RF radiation in a short wavelength spectral region may be more efficiently absorbed in portion 1033 than it is in portion 1031. Likewise, a long wavelength spectral region may be more efficiently absorbed in portion 1031 than it is in portion 1033. Thus, a different amount of heat is generated from portions 1021, 1022, and 1023 in RF receiver structure 1014 upon receiving RF radiation with a selected bandwidth.

The shape and size of regions 1021, 1022, and 1023 may be determined according to different heat desirability for a substrate portion overlapping the regions. To obtain uniform bonding the adhesive may be desirably heated at the same temperature across a certain area of a substrate, according to some embodiments. However, the substrate portion overlapping an adhesive layer may have different heat conductivities in different portions. For example, in some embodiments a first substrate portion may include steel, and in some embodiments a second substrate portion may include aluminum. A graded grid having regions 1021, 1022, and 1023 absorbs RF energy with different efficiency in each of the regions. Thus, RF receiving structure 1014 provides a differentiated amount of heat to the adhesive in the vicinity of each of regions 1021, 1022, and 1023. And each of regions 1021, 1022, and 1023 focuses different amounts of heat according to the heat conductivity of the substrate portion proximal to that region (e.g., steel or aluminum, as described above). In such embodiments, the adhesive layer (e.g., layers 210 and 212, cf. FIG. 2) can reach approximately the same temperature, resulting in uniform bonding across an area overlapping regions 1021, 1022, and 1023.

In some embodiments, it may be desirable that different portions of the substrate be heated at different temperatures, due to different bonding requirements. For example, a portion of a substrate overlapping region 521 may include an adhesive layer that is activated at a first temperature. And a portion of a substrate overlapping region 1022 may include an adhesive layer that is activated at a second temperature. The first temperature may be different from the second temperature. For example, the first temperature may be lower than the second temperature. In such configuration, pitch 1031 in region 1021 may be selected to absorb an amount of RF radiation lower than the amount of RF radiation absorbed by region 1022. Thus, the amount of heat provided by region 1021 is lower than the amount of heat provided by region 1022, resulting in a lower first temperature, compared to the second temperature.

The number of mesh regions illustrated in FIG. 10 is illustrative only, and should not be limiting in any respect. Accordingly, one of ordinary skill in the art will recognize that different shapes and areas of different mesh regions may be combined. For example, the pitch 1031, 1032, and 1033 in adjacent regions may not gradually change in size. Thus, in some embodiments a region such as region 1021 including pitch 1031 may be adjacent to region 1023, including pitch 1033. And region 1023 including pitch 1033 may be adjacent to region 1022. Thus, in some embodiments regions 1021 and 1022 may not be adjacent to each other. Moreover, the grid in RF receiving structure 1014 can have a square lattice shape, as shown, and any other shape, such as: triangular, hexagonal, rhomboid, or irregular shape.

The particular choice of Cartesian coordinates XY in FIG. 10 corresponds to a 'right-handed' XYZ coordinate system consistent to that of FIG. 2.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for bonding a first device component to a second device component within an electronic device, the method comprising:

directing an alternating magnetic field at a driving frequency to a stack structure having an electrically conductive receiver structure located between a first thermal adhesive layer and a second thermal adhesive layer while the stack structure is positioned between the first and second device components, the receiver structure having a first metal at a first receiver structure portion and a second metal at a second receiver structure portion, wherein the first and second device components are not substantially heated thereby and the receiver structure is tuned such that a substantial portion of the alternating magnetic field is converted to heat at the receiver structure;

allowing the heat at the receiver structure to transmit conductively into the first and second thermal adhesive layers in varying amounts of heat at different locations in the stack structure, wherein the second thermal adhesive layer has a thickness that is thicker than the first thermal adhesive layer; and ceasing direction of the alternating magnetic field after sufficient heat has been transmitted into the first and second thermal adhesive layers to activate the first and second thermal adhesive layers and bond the first and second device components.

2. The method of claim 1, wherein heat transfer into the first and second thermal adhesive layers results in an asymmetric thermal gradient across the first and second thermal adhesive layers.

3. The method of claim 2, wherein the asymmetric thermal gradient results in the first device component receiving more heat than the second device component.

4. The method of claim 1, wherein temperatures at the receiver structure reach or exceed about 140° C. while temperatures at the first and second device components remain at or below about 85° C.

5. The method of claim 1, wherein other electronic device components outside and proximate the first and second device components are not exposed to damaging heat levels.

6. The method of claim 1, wherein heat transfer into the first and second thermal adhesive layers is symmetric despite the thickness difference in the thermal adhesive layers.

7. The method of claim 1, wherein the first metal is steel and the second metal is aluminum.

8. The method of claim 1, wherein the receiver structure comprises a first wire mesh having a first pitch at a first receiver structure portion, a second wire mesh having a second pitch at a second receiver structure portion, and a third wire mesh having a third pitch at a third receiver structure portion.

9. A method for bonding adherent components, the method comprising:

directing an alternating magnetic field at a driving frequency to an electrically conductive receiver positioned proximate at least one thermal adhesive component and between first and second adherent components, the electrically conductive receiver having a first metal at a first electrically conductive receiver portion and a second metal at a second electrically conductive receiver portion, wherein the electrically conductive receiver has asymmetric thermal properties thereacross and is tuned such that a substantial portion of the alternating magnetic field is converted to heat at the electrically conductive receiver; and allowing a sufficient amount of heat at the electrically conductive receiver to transmit conductively into the at least one thermal adhesive component in order to activate the at least one thermal adhesive component and thereby bond the first and second adherent components, wherein the heat is transmitted asymmetrically.

10. The method of claim 9, wherein the varying structure of the electrically conductive receiver comprises a layered structure having a magnetic field absorbing material on one side and a low heat conducting material on the other side.

11. The method of claim 10, wherein the low heat conducting material on the other side is a ceramic material.

12. The method of claim 9, wherein the varying structure of the electrically conductive receiver comprises a first wire mesh having a first pitch at a first electrically conductive receiver portion, a second wire mesh having a second pitch at a second electrically conductive receiver portion, and a third wire mesh having a third pitch at a third electrically conductive receiver portion.

13. A method for bonding adherent components, the method comprising:

directing a first alternating magnetic field at a first driving frequency to an electrically conductive receiver positioned proximate at least one thermal adhesive component and between first and second adherent components, the electrically conductive receiver comprising a first portion having a first set of thermal properties and a second portion having a second set of thermal properties different from the first set of thermal properties, wherein the first portion of the electrically conductive receiver is tuned such that the first alternating magnetic field at the first driving frequency is converted to a substantial amount of heat at the first portion of the electrically conductive receiver, and the second portion of the electrically conductive receiver is tuned such that the first alternating magnetic field at the first driving frequency is not converted to a substantial amount of heat at the second portion of the electrically conductive receiver;

allowing a sufficient amount of heat at the first portion of the electrically conductive receiver to transmit conductively into a first portion of the at least one thermal adhesive component in order to activate the first portion of the at least one thermal adhesive component;

directing a second alternating magnetic field at a second driving frequency to the electrically conductive receiver, wherein the first portion of the electrically conductive receiver is tuned such that the second alternating magnetic field at the second driving frequency is not converted to a substantial amount of heat at the first portion of the electrically conductive receiver, and the second portion of the electrically conductive receiver is tuned such that the second alternating magnetic field at the second driving frequency is converted to a substantial amount of heat at the second portion of the electrically conductive receiver; and allowing a sufficient amount of heat at the second portion of the electrically conductive receiver to transmit conductively into a second portion of the at least one thermal adhesive component in order to activate the second portion of the at least one thermal adhesive component.

14. The method of claim 13, wherein the electrically conductive receiver further comprises a third portion having a third set of thermal properties different from the first and second sets of thermal properties, the method further comprising:

directing a third alternating magnetic field at a third driving frequency to the electrically conductive receiver, wherein the first and second portions of the electrically conductive receiver are tuned such that the third alternating magnetic field at the third driving frequency is not converted to a substantial amount of heat at the first and second portions of the electrically conductive receiver, and the third portion of the electrically conductive receiver is tuned such that the third alternating magnetic field at the third driving frequency is converted to a substantial amount of heat at the third portion of the electrically conductive receiver; and allowing a sufficient amount of heat at the third portion of the electrically conductive receiver to transmit conductively into a third portion of the at least one thermal adhesive component in order to activate the third portion of the at least one thermal adhesive component.

15. The method of claim 14, wherein the first portion of the electrically conductive receiver comprises a first wire mesh having a first pitch, the second portion of the electrically conductive receiver comprises a second wire mesh having a second pitch, and the third portion of the electrically conductive receiver comprises a third wire mesh having a third pitch.

16. The method of claim 13, wherein the first portion of the electrically conductive receiver comprises a first metal and the second portion of the electrically conductive receiver comprises a second metal.

17. The method of claim 13, wherein the first portion of the electrically conductive receiver comprises a layer formed from a low heat conducting material and the second portion of the electrically conductive receiver does not comprise a layer formed from a low heat conducting material.

* * * * *